US006884306B1

(12) United States Patent
Mawella et al.

(10) Patent No.: US 6,884,306 B1
(45) Date of Patent: Apr. 26, 2005

(54) BAINTIC STEEL

(75) Inventors: Kankanange J A Mawella, Farnborough (GB); Francisca G Caballero, Cambridge (GB); Harshad K D H Bhadeshia, Cambridge (GB)

(73) Assignee: Qinetiq Limited, Hants (GB)

( * ) Notice: Subject to any disclaimer, the term of this patent is extended or adjusted under 35 U.S.C. 154(b) by 258 days.

(21) Appl. No.: 10/048,619

(22) PCT Filed: Aug. 2, 2000

(86) PCT No.: PCT/GB00/02914

§ 371 (c)(1),
(2), (4) Date: Feb. 7, 2002

(87) PCT Pub. No.: WO01/11096

PCT Pub. Date: Feb. 15, 2001

(30) Foreign Application Priority Data

Aug. 4, 1999 (GB) ..... 9918240

(51) Int. Cl.[7] ..... C21D 9/00
(52) U.S. Cl. ..... 148/662; 148/334; 148/335
(58) Field of Search ..... 148/662, 334, 148/335; 420/111, 109

(56) References Cited

U.S. PATENT DOCUMENTS 3,519,497 A * 7/1970 Pomey ..... 148/582
4,957,702 A * 9/1990 Fang et al. ..... 420/104

FOREIGN PATENT DOCUMENTS

| | | |
|---|---|---|
| EP | 0 462 779 A2 | 12/1991 |
| EP | 0 794 262 A1 | 9/1997 |
| EP | 0 849 368 A | 6/1998 |
| GB | 399643 | 10/1933 |
| GB | 517118 | 1/1940 |
| GB | 1131662 | 10/1968 |
| JP | 4-301031 | 10/1992 |
| JP | 5-320749 | 12/1993 |
| JP | 9-241732 | 9/1997 |

OTHER PUBLICATIONS

Patent Abstracts of Japan vol. 014, No. 232 (C–0719), May 17, 1990 & JP 02 057637 A (Nippon Steel Corp), Feb. 27, 1990 abstract.

Chemical Abstracts, vol. 132, No. 16, Apr. 17, 2000, Columbus, Ohio, US; abstract No. 210668, Tomita, Yoshiyuki et al: "Modified austempering effects on Fe–O.6C–1.551–0.8Mn steel" XP002153889, abstract, & Bull. Osaka Prefect. Univ., Ser. A (1997), 46(2), 125–131, 1997.

Patent Abstracts of Japan vol. 015, No. 496 (C–0894), Dec. 16, 1991 (Feb. 6, 1991) & JP 03 215623 A (Nissnin Steel Co Ltd), Sep. 20, 1991 abstract.

JP 060271930 A; (NISSHIN) WPI Abstract Accession No. 94–347429/43 and PAJ vol. 018, No. 686, Sep. 27, 1994.

JP 060228734 A, (NISSHIN) WPI Abstract Accession No. 94–300212/37 and PAJ vol. 018, No. 604, Aug. 16, 1994.

JP 020057637 A, (NIPPON) WPI Abstract Accession No. 90–105048/14 and PAJ vol. 014, No. 232, Feb. 27, 1990.

* cited by examiner

*Primary Examiner*—Deborah Yee
(74) *Attorney, Agent, or Firm*—Nixon & Vanderhye P.C.

(57) ABSTRACT

A mainly bainitic steel having the following composition in weight percent: carbon 0.6–1.1; silicon 1.5 to 2.0; manganese 1.8 to 4.0; chromium 1.2 to 1.4; nickel 0–3; molybdenum 0.2 to 0.5; vanadium 0.1 to 0.2, balance iron save for incidental impurities.

2 Claims, 4 Drawing Sheets

M=martensite, B=bainite, C=primary cementite, and P=pearlite

BAINTIC STEEL

This application is the US national phase of international application PCT/GB00/01914 filed 2 Aug. 2000, which designated the US.

The invention relates to a high carbon steel having good properties of strength hardness, and resistance to heat treatments. It also relates to a method of producing such steels.

It is a continuing desire to improve the strength of high carbon, high silicon steels.

The inventors have determined a steel composition which has high hardness, high strength and high ductility and have further devised a method to produce such a steel. The invention comprised a steel having a composition by weight of carbon 0.6 to 1.1%, silicon 1.5 to 2.0%, manganese 1.8 to 4.0%, nickel 0 to 3%, chromium 1.2 to 1.4%, molybdenum 0.2 to 0.5%, vanadium 0.1–0.2%, balance iron save for incidental impurities.

The steel may have incidental impurities which are not deliberate additions.

Preferably the steel has the following composition in weight percent; carbon 0.7 to 0.9%; silicon 1.5 to 1.7%; manganese 1.9 to 2.2%; chromium 1.25 to 1.4%; nickel 0 to 0.05%; molybdenum 0.25 to 0.35%; vanadium 0.1 to 0.15%, balance iron save for incidental impurities.

Preferably the steel is of mainly bainitic microstructure improving hardness, yield stress and ultimate tensile strength. Mainly bainitic microstructure is defined as at least 50% of bainitic structure, preferably 65% and even more preferably 85% although 95% is achievable. The rest of the structure comprises retained austenite.

The invention will now be described by way of example only and with reference to the following figures of which:

Figure 1:
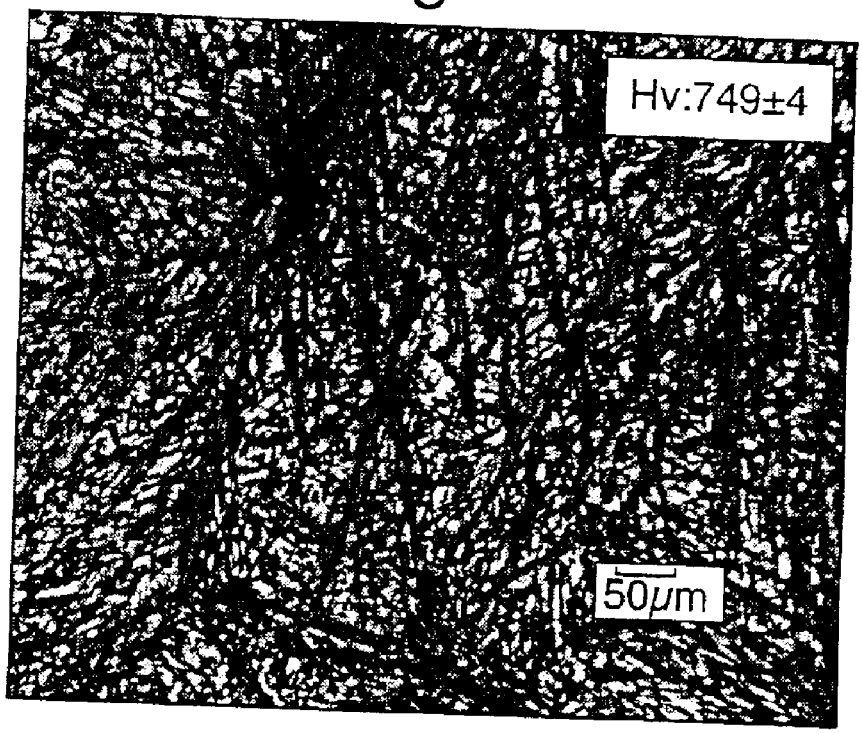
FIG. 1 shows the microstructure showing a mixture martensite and austenite only, following a homogenisation heat treatment at 1200° C. for two days.

Steel having the following composition by weight of carbon 0.79%, silicon 1.59%, manganese 1.94%, chromium 1.33%, molybdenum 0.3%, vanadium 0.11%, nickel 0.02% was supplied as cast 12 mm diameter bar. It was homogenised at 1200° C. for two days in evacuated quartz capsules and subsequently air-cooled. 3 mm diameter rods were austenitised for 15 min at 1000° C. isothermally transformed at temperature ranging from 150 to 500° C. for different times and subsequently quenched into water. In all the figures and results given steels were formulated with this composition.

FIG. 1 shows the microstructure showing a mixture martensite and austenite only, following a homogenisation heat treatment at 1200° C. for two days.

Table 1 lists all the temperatures holding times and hardness values of the micro structures obtained after isothermal decomposition of austenite

| Temperature/Time (weeks) | Hv (kgf/mm2) |
|---|---|
| 150° C./0.06 | 734 |
| 150° C./1 | 761 |
| 150° C./2 | 763 |
| 190° C./1 | 618 |
| 190° C./2 | 648 |
| 250° C./1 | 617 |
| 250° C./2 | 654 |
| 300° C./1 | 434 |
| 300° C./2 | 442 |
| 350° C./1 | 409 |
| 350° C./2 | 745 |
| 400° C./1 | 732 |
| 400° C./2 | 769 |
| 450° C./1 | 642 |
| 500° C./1 | 476 |

Figure 2:
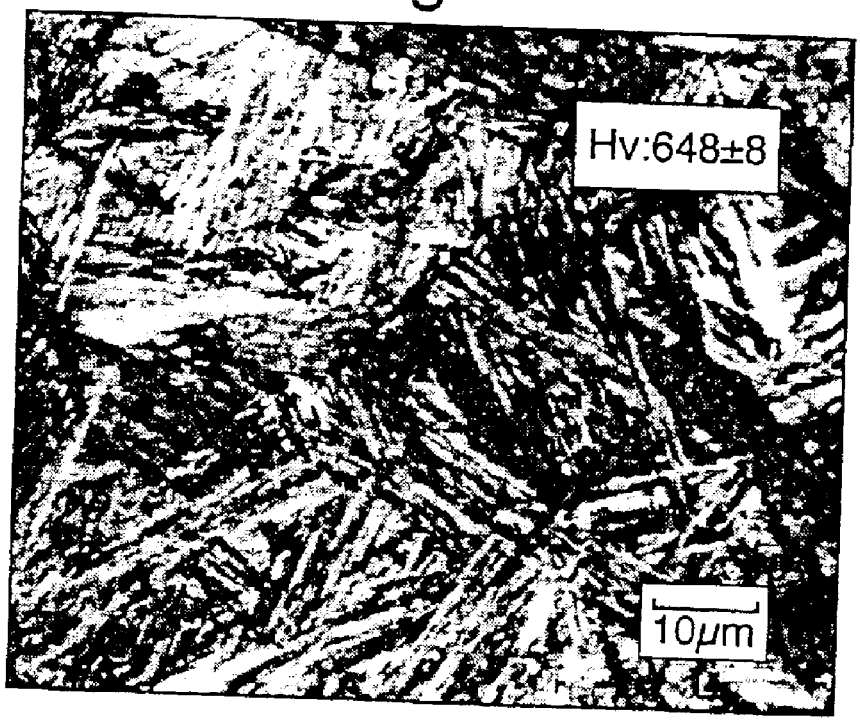
FIG. 2 shows a microstructure of a steel according to the invention having a bainitic structure.

FIG. 2 shows microstructure of the steel formed at 190° C. for two weeks and shows a mixture of bainitic ferrite and carbon-enriched retained austenite.

Figure 3:
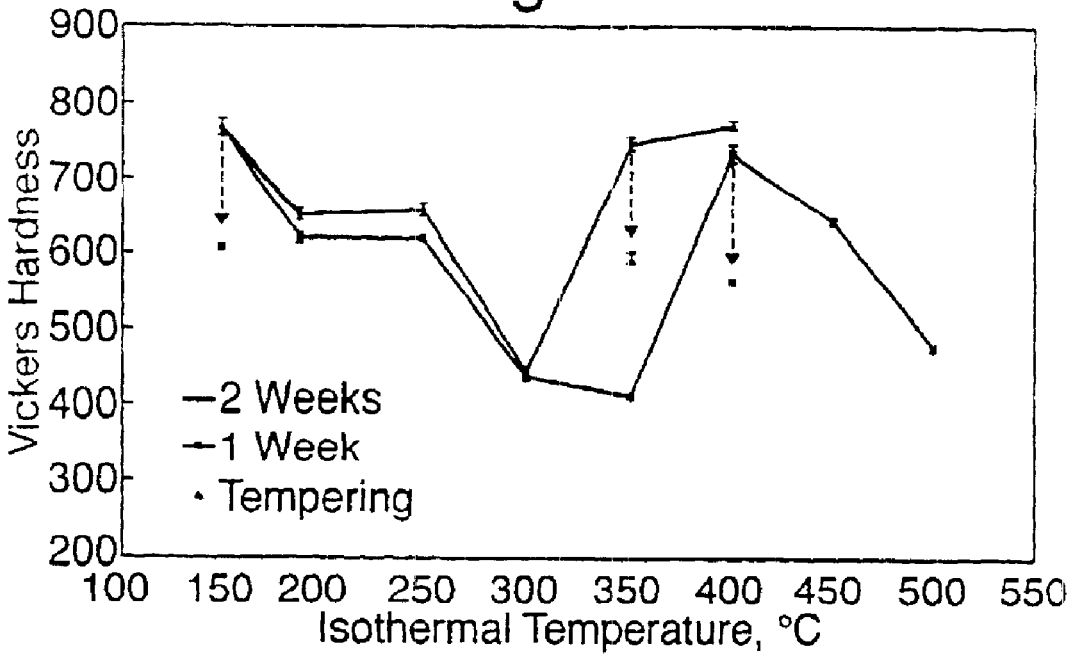
FIG. 3 shows hardness against three regimes of heat treatment.

FIG. 3 shows a plot of hardness against isothermal transformation temperature. The increase in hardness detected at 350° C. after two weeks of isothermal treatment suggests that the start bainite temperature should be at this level. The microstructures formed at 150°, 350° and 400° are different from those obtained between 190° C. and 300° C. for two weeks and tempering at 400° C. for an hour has shown that the 150° C. and 400° C. microstructures are martensite whereas the 190–300° C. microstructures were bainite. A reduction the hardness after low temperature tempering usually confirms the presence of martensite instead of bainite in a microstructure. The microstructures formed at 450° C. and 500° C. are mixture of pearlite and retained austenite. Additionally some proeutectoid cementite with plate morphology seems to have been formed. A fully bainitic microstructure with extraordinary hardness and resistance to tempering is formed at 190° C. when transformed for two weeks. Also the maximum volume fraction of bainite obtained increases with the decreasing transformation temperature.

According to the results from the inventors, the carbon composition of austenite after bainite transformation is much lower than expected from equilibrium and there is not significant enrichment of the residual austenite. This is because the carbide particles precipitate inside the plates of ferrite and lower bainite is formed instead of upper bainite. The carbides in the lower bainite should be extremely fine. The fine microstructure of lower bainite is expected to be much tougher than upper bainite in spite of fact that it should be stronger. The lower bainite structure is formed when isothermal transformation temperatures of up to around 350° C. are used. The upper bainite structure is formed when isothermal transformation temperatures of over around 350° C. are used.

Figure 4:
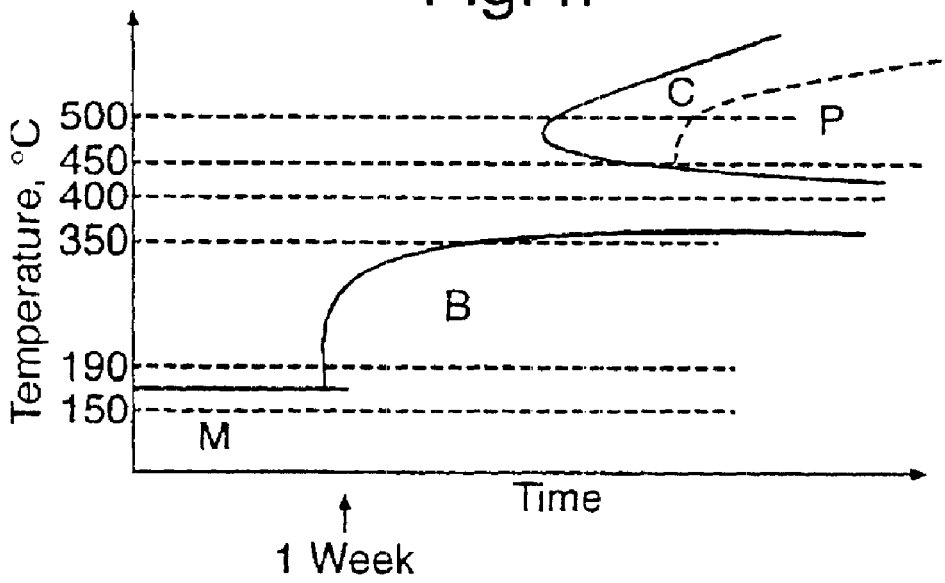
FIG. 4 shows a time—temperature—transformation (TTT) diagram of a steel according to the invention.

FIG. 4 shows a schematic representation of the TTT diagram of the steel.

Figure 5:
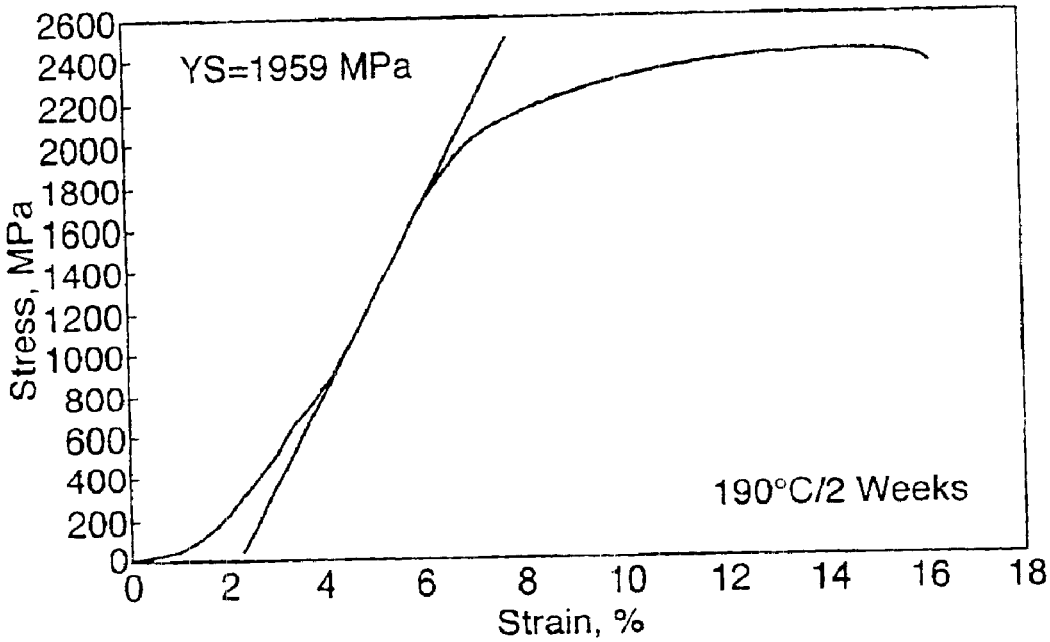
FIGS. 5 and 6 show compression and tension curves for microstructure of the steel formed following isothermal transformation at 190° C. for two weeks.
Figure 6:
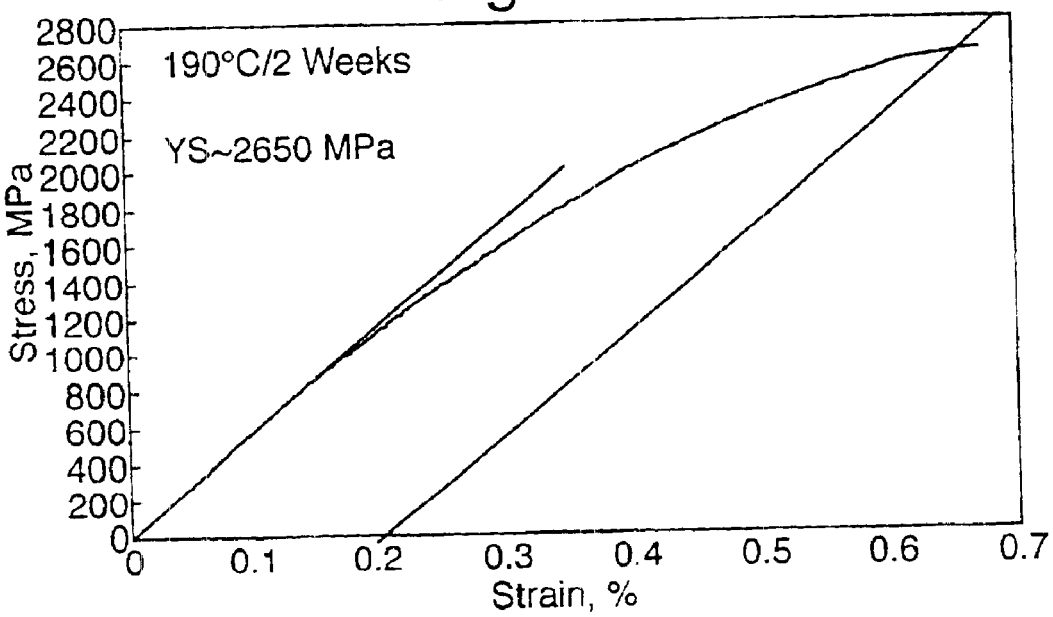

FIGS. 5 and 6 show results of testing the compression and tension curves of samples which have been isothermally transformed at 190° C. for two weeks to produce bainite. The material has very high strength under both compression and tension. Charpy tests in this cast and heat treated condition gave absorbed energy values of only 5+/−1 J.

Figure 7:
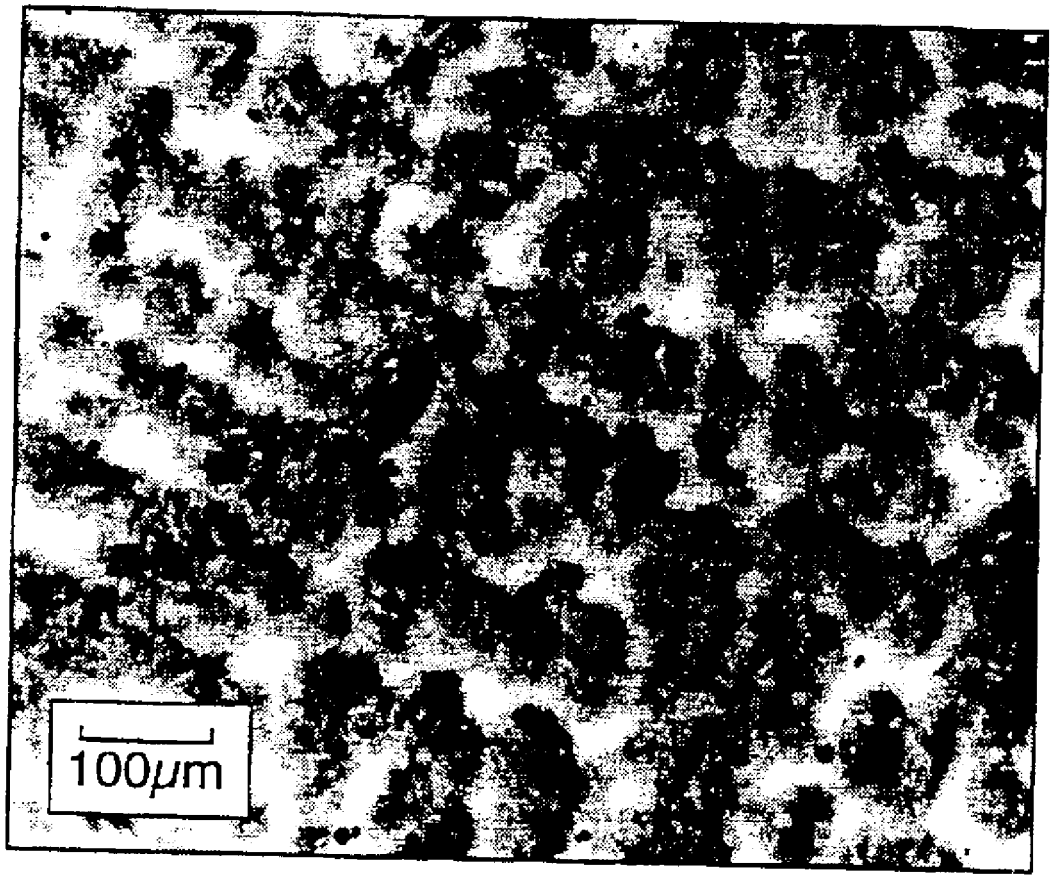
FIG. 7 shows the microstructure formed at 190° C. for two weeks from as-cast material.

A homogenisation heat treatment is necessary in order to get a uniform and fully bainitic microstructure by isothermal heat treatment. FIG. 7 shows the microstructure obtained at 190° C. for two weeks from fresh material; segregation is clear in the sample and the volume fraction of austenite appears to be higher. This microstructure was tested under compression and no significant difference from the yield strength estimated with homogenised sample was found. Never the less toughness may be poorer because of the blocky austenite present in the dendrite microstructure.

A different homogenisation heat treatment avoids the formation of martensite. Samples are homogenised at 1200° C. for two days and then isothermally transformed to pearlite or bainite before cooling to room temperature. Then reheated to 1000° C. to refine austenite grain size and then transformed again to bainite.

What is claimed is:

1. A method of heat treating a steel to produce a mainly bainitic structure, wherein the steel has the following composition in weight percent;

carbon 0.6–1.1;

silicon 1.5 to 2.0;

manganese 1.8 to 4.0;

chromium 1.2 to 1.4;

nickel 0–3;

molybdenum 0.2 to 0.5;

vanadium 0.1 to 0.2, balance iron save for incidental impurities; and, wherein the method comprises the steps of:

homogenising the steel at a temperature of at least 1150° C. for at least 24 hours;

air cooling the steel;

subjecting the steel to a temperature between 900° C. and 1000° C.;

isothermally transforming the steel at a temperature between 190° C. and 260° C. for 1 to 3 weeks.

2. A method of heat treating a steel to produce a mainly bainitic structure, wherein the steel has the following composition in weight percent:

carbon 0.7 to 0.9;

silicon 1.5 to 1.7;

manganese 1.9 to 2.2;

chromium 1.25 to 1.4;

nickel 0 to 0.05;

molybdenum 0.25 to 0.35;

vanadium 0.1 to 0.15, balance iron save for incidental impurities; and, wherein the method comprises the steps of:

homogenising the steel at a temperature of at least 1150° C. for at least 24 hours;

air cooling the steel;

subjecting the steel to a temperature between 900° C. and 1000° C.; and, isothermally transforming the steel at a temperature between 190° C. and 260° C. for 1 to 3 weeks.

* * * * *